US010597220B2

(12) United States Patent
Moss et al.

(10) Patent No.: US 10,597,220 B2
(45) Date of Patent: Mar. 24, 2020

(54) DEVICE FOR PRODUCING SCLEROSING MICROFOAM

(71) Applicant: PROVENSIS LIMITED, London Greater London (GB)

(72) Inventors: Stafford Guy Moss, London Greater London (GB); David Dakin Iorwerth Wright, London Greater London (GB); David Ian Faulkner, London Greater London (GB)

(73) Assignee: PROVENSIS LIMITED, London, Greater London (GB)

( * ) Notice: Subject to any disclaimer, the term of this patent is extended or adjusted under 35 U.S.C. 154(b) by 100 days.

(21) Appl. No.: 15/574,221

(22) PCT Filed: Jul. 20, 2016

(86) PCT No.: PCT/IB2016/054309
§ 371 (c)(1),
(2) Date: Nov. 15, 2017

(87) PCT Pub. No.: WO2017/013592
PCT Pub. Date: Jan. 26, 2017

(65) Prior Publication Data

US 2018/0134480 A1 May 17, 2018

(30) Foreign Application Priority Data

Jul. 21, 2015 (GB) ..... 1512804.4

(51) Int. Cl.
*B65D 83/42* (2006.01)
*B65D 41/06* (2006.01)
(Continued)

(52) U.S. Cl.
CPC ..... *B65D 83/425* (2013.01); *A61J 1/2089* (2013.01); *B65D 41/06* (2013.01); *B65D 83/205* (2013.01)

(58) Field of Classification Search
CPC .... B65D 83/425; B65D 83/205; B65D 83/40; B65D 83/14; B65D 83/28; B65D 83/42; B65D 41/04; B65D 41/06; A61J 1/2089
See application file for complete search history.

(56) References Cited

U.S. PATENT DOCUMENTS 3,497,110 A * 2/1970 More ..... B65D 83/72 222/146.1
9,457,160 B2 * 10/2016 Wright ..... A61K 9/12
(Continued)

FOREIGN PATENT DOCUMENTS

FR 2 761 957 A1 10/1998
WO WO 02/41872 * 5/2002 ..... A61K 9/12
(Continued)

*Primary Examiner* — Nicolas A Arnett
(74) *Attorney, Agent, or Firm* — Finnegan, Henderson, Farabow, Garrett & Dunner LLP

(57) ABSTRACT

This invention relates to apparatus and devices that generate sclerosing microfoams for the treatment of venous disorders, such as varicose veins. The invention includes adaptors which provide fluid connections to microfoam generating devices, to enable filling with gas and/or dispensing of the microfoam product. The adaptors are generally cylindrical elements with open ends to enable attachment to pressurisable container on one end and are configured to enable rapid and easy attachment of a filling means or a dispensing means through the other end of the adaptor. A particular configuration comprises three or more circumferentially and downward extending cam tracks which cooperate with corresponding cams on the filling means or dispensing means and which connect a pressurisable container to a fluid path of a filling or dispensing means when the pressurisable
(Continued)

Figure 1A:
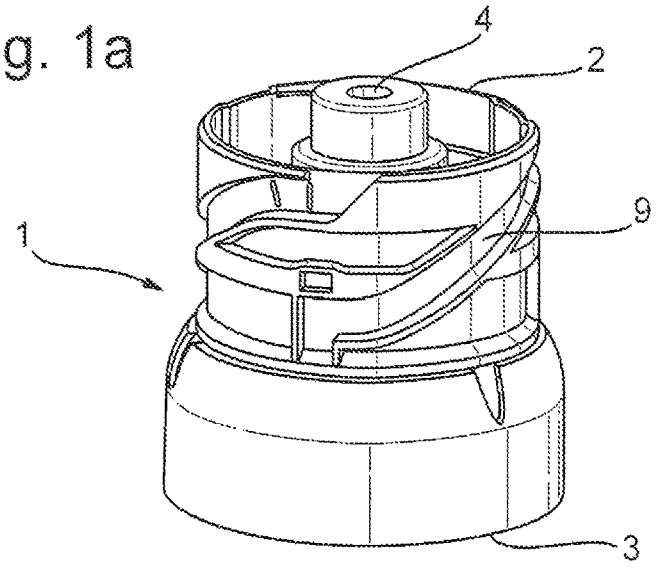

container and filling or dispensing means are rotated relative to each other.

17 Claims, 6 Drawing Sheets

(51) Int. Cl.
*B65D 83/20* (2006.01)
*A61J 1/20* (2006.01)

(56) References Cited

U.S. PATENT DOCUMENTS

2007/0051426 A1* 3/2007 Harman ..... B65B 3/22 141/319
2011/0024448 A1* 2/2011 Harman ..... B65B 3/22 222/1
2012/0304991 A1* 12/2012 Gotliboym ..... A61M 15/0003 128/203.15
2018/0134480 A1* 5/2018 Moss ..... A61J 1/2089

FOREIGN PATENT DOCUMENTS

WO WO 2005/023678 A1 3/2005
WO WO 2011/059968 A1 5/2011

* cited by examiner

DEVICE FOR PRODUCING SCLEROSING MICROFOAM

This application is the U.S. national phase of International Application No. PCT/IB2016/054309filed Jul 20, 2016 which designated the U.S. and claims priority to British Patent Application No. 1512804.4 filed Jul. 21, 2015, the entire contents of each of which are hereby incorporated by reference.

This invention relates to apparatus and devices that generate sclerosing microfoams, which are useful in the treatment of venous disorders, such as varicose veins and other venous malformations. The invention includes adaptors which provide fluid connections to the devices to enable filling with gas and/or dispensing of the microfoam produced.

The treatment of venous disorders with sclerosing foams and microfoams is well known, as are devices for making sclerosing foams.

WO 02/41872 describes a canister-based device which produces a sclerosing microfoam of defined density and half-life in a reproducible manner. The device comprises 2 canisters configured to keep gas and liquid components separate during storage, so as to avoid decomposition (oxidation) of alcoholic sclerosing agents in the presence of pressurised oxygen.

In the device of WO 02/41872, blood-dispersible gas is stored in a first container, which is provided with engaging means for a second container holding the aqueous sclerosant liquid. This engaging means comprises an intermediate element, which enables transfer of gas from one container into the other, until a pre-determined pressure is reached. Part of the intermediate element is then removed before the microfoam is produced by passing liquid and gas through a foaming element and dispensed into a syringe.

In a particular embodiment of the device described by WO 02/41872, the engaging means comprises a cylindrical connector with a cam track to enable connection of the two canisters by rotation, following the path of the cam track. There is no disclosure in WO 02/41872 of the number, size, or orientation of the cam tracks nor is there any indication as to ease of use of the device and reproducibility of connection and gas transfer when in use.

The Applicant has manufactured, tested and sold the bi-canister devices described by WO 02/41872. The bi-canister device and microfoam produced from it is the subject of a marketing authorisation issued by the US Food and Drug Administration (FDA). In clinical trials, the devices have been shown to consistently and reliably produce sclerosing microfoam to a tightly defined specification, when following the instructions for use.

However, additional testing of the intermediate element used to connect the two canisters has shown that, on occasion, the canister which is filled with blood dispersible gas fails to make a complete connection with the valve of the canister containing the sclerosing agent such that the valve is not activated or that the valve is activated but the connection is not complete and some or all of the gas leaks to atmosphere, rather than being completely transferred to the other container. It is thought that flexibility of movement around the cam track allows for the cam to move out of the track if the user is too heavy-handed or as the user adjusts his grip, as is often necessary to rotate the canisters through the approximately 180 degrees required to fully connect the cans.

The present invention addresses these problems by providing improved adaptors and foam producing devices. The adaptors and device of the invention still enable oxygen or other potentially reactive materials to be stored separately from the sclerosing agent during long term storage (which may range from one or more days to 18 or 24 months or even longer) but in a form that enables simple, reliable and quick connection so that cans can be easily activated at the time of use, and with increased confidence that activation will be successful. It will be understood that in the context of the present invention, "activation" means connecting a source of blood dispersible gas to the second container holding a sclerosant liquid and enabling transfer of the blood dispersible gas from the first container to the second, substantially without leaking to create the final mixture of aqueous sclerosant liquid and gas required to generate the required foam. A particular advantage over the prior art devices is that the connection can be made with a single movement i.e. rotation of one component relative to the other through the adaptor, without the need for the user to adjust his grip to complete the rotation and enable complete connection. In usability studies, the devices of the invention have been found to have a decreased failure rate (failed or incomplete connection) with users reporting significantly increased ease of use.

In a first aspect, the invention provides an adaptor for connecting a filling or dispensing means to a valve of a pressurisable container, said adaptor comprising:

- a cylindrical element with open ends and an inner wall and an outer wall therebetween, said open ends comprising a first open end configured to enable attachment to said pressurisable container and an second open end configured to enable attachment of a filling means or a dispensing means;
- an inner bore to accommodate the valve of the pressurisable container and enable engagement of the valve with the filling means or dispensing means when attached through the second open end of the device;

characterised in that the outer wall of the adaptor comprises three or more circumferentially extending, downward facing cam tracks which cooperate with corresponding cams on the filling means or dispensing means to move the filling or dispensing means and the pressurisable container closer together and enable connection of the valve of the pressurisable container to a fluid path of the filling or dispensing means, when the pressurisable container and filling or dispensing means are rotated relative to each other.

Complete connection is achieved when the cams travel to the terminal end of the cam tracks.

In a particular embodiment of the first aspect the adaptor is arranged such that the second open end is oriented as an upper open end and the first open end, a lower open end.

It will be understood in this embodiment that downward facing relates to the direction of travel during the clockwise rotation of the source of gas (or filling means) around the circumference of the adaptor from the second, upper open end towards the first, lower, open end of the adaptor, The number, length, depth and angle of the cam tracks can be readily determined by the height and diameter of the adaptor i.e. the tracks must be of sufficient length and gradient to ensure complete connection of the filling or dispensing means to the valve of the pressurisable container with a single, preferably short, twist (in terms of degrees of rotation of one container relative to the other). The cam tracks may be formed by etching the wall of the adaptor such that the tracks appear sunken relative to the wall or they may be defined by walls which protrude from the adaptor wall. Conveniently, tracks which are defined by walls which protrude from the outer surface of the adaptor may be produced using standard injection moulding techniques. In a particular embodiment the cam tracks are evenly spaced around the circumference of the cylindrical element but arranged on the outward wall of the cylinder to create a track in which a "start" position of each track around the circumference of the cylinder is above the terminal end or "stop" position of one other track i.e. the track are arranged as downward facing but otherwise overlapping arcs around the adaptor wall (if collapsed to one dimension). In this way, improved circumferential contact between the adaptor and the filling or dispensing means is achieved throughout the movement of the cams along the track, which prevents slippage and cam displacement.

The inventors have found that three cam tracks, preferably as described above, are sufficient to provide a robust connection, with little movement of the respective containers during the connection and also require less rotational displacement to make connection achievable with a short, single twist. However, four, five or even six or more cam and track combinations could be incorporated in the same manner as described above, for example, to provide stability for larger size canisters and/or for reducing further the degrees of rotation required for complete connection of the two parts.

The adaptor enables simple and complete attachment of a filling means or a dispensing means to the pressurisable container. The filling means is most likely to be a source of pressurised gas and may take the form of a prefilled canister, cartridge or bulb (such as a "Sparklet™ bulb") that has been adapted to provide cams to cooperate with the cam tracks on the adaptor. The dispensing device will be any device which is capable of actuating the valve on the pressurisable container and delivering the foam to a syringe for injection or, in certain circumstance, directly to the patient via catheter or other suitable medical tubing. In particular embodiments, the dispensing means may be a syringe itself, provided it is adapted with cams to cooperate with the cam track of the adaptor. In one embodiment the dispensing means is a manometer tube or similar medically acceptable tubing which is adapted to cooperate with the adaptor at one end and which enables delivery of the sclerosant microfoam, via needle or catheter, directly into a vein of the patient. As will be understood by the skilled person, references herein to the connection of the adaptor to the filling means will apply equally to the connection of a dispensing means, unless otherwise stated.

The adaptor may be supplied already attached to the pressurisable container and/or to the filling means or the dispensing means. Where the adaptor is supplied attached to both the pressurisable container and a filling means (i.e. attached to the lower open end and the upper open end of the adaptor), it may be desirable for the adaptor to comprise at least one cam track which has one or more detents, protrusions or catches provided in the track to prevent inadvertant rotation of the containers and/or to enable the user to gauge the progress of the connection. In this way inadvertent or premature activation/connection can be avoided. This is important in situations where the length of time between filling the pressurisable container and using it to produce foam has to be carefully controlled, for example, if the contents are reactive or are unstable but can also be used as a means of confirming product security, providing the user with assurance that the device has not been used.

In a particular embodiment at least two detents or protrusions are provided in an upper portion of the track and which, prior to rotation, are positioned either side of a cam on the filling means to ensure stable connection. Depending on the size of the detents and the force required to move the cams over them, may be chosen to increase or decrease the force required to move the containers about the adaptor and consequently make connection easier or more difficult as desired for any particular application.

Other features and modifications that may be included with the cam track mechanism to improve control and increase ease of use include the provision of a "click-stop" at the terminal end of the cam track. The click-stop is a mechanical feature of the terminal end of the cam track and provides an audible and tactile signal when the cam touches or interacts with it. The click-stop may be provided by a relatively shallow protrusion extending upwards from the base of the cam track or may simply be the terminal, lower end of the cam track, which provides a hard stop when it comes into contact with a cam and acts to prevent further rotation of the filling or dispensing means relative to the pressurisable container. In this way, over-rotation of the container about the adaptor is prevented and the frequency of moving the cams out of the tracks (and hence failure or incomplete connection) is significantly reduce or is avoided completely. In a particular embodiment the click-stop is providing by a ramped protrusion i.e. a protrusion extending from the base of bottom of the cam track and with the height of the protrusion increasing in the direction in which the cams travel along the cam track, during connection through the adaptor. The ramp shape of the protrusion enables a smooth journey over the click-stop but with the advantages that a loud click will be heard as the cam "falls" off the high end of the ramp but also that backwards rotation in the reverse direction will also be prevented without the application of some force.

The angle of rotation required to connect the valve to the filling or dispensing means and provide a fluid path therebetween can be varied and controlled by controlling the length and the relative gradient of the cam track. However, in order to ensure that the angle of rotation through which the user must twist the containers around the adaptor is kept such that complete connection can be achieved with a single, short movement, it is preferred that the angle of rotation is 120 degrees or less. Angles or rotation of between 40 and 100 degrees are particularly useful and angles of between 60 and 90 degrees provide a good compromise between a useful distance of travel around the adaptor and a relatively small angle of rotation to enable simple connection.

Consequently, it is preferred that the adaptor has a cam track which defines a pathway with gradient of approximately 35 degrees relative to the lower end of the adaptor. The skilled person will understand that the higher angles with reduce the overall distance (axial displacement) through which the cams will have to travel along the cam track (or the connecting containers relative to each other) to achieve complete connection with the valve. Angles of between 20 and 50 degrees are therefore contemplated within the invention and are considered to work with the other features of the adaptor to ensure simple and reliable connection.

The pathway of the cam track need not be straight-line (or at a single gradient through the entire arc of the cam track around the outer circumferential wall of the adaptor). To further improve ease of use, the adaptor may have cam tracks defining a pathway characterised by an initial and a final portion with gradient between 0 and 5 degrees, with a central higher gradient which is in the region of 20 to 40 degrees, and preferably around 35 degrees, relative to the lower end of the adaptor.

This embodiment with three cam tracks providing three parallel pathways which extend around the entire circumference of the adaptor is particularly advantageous because it represents the correct balance between the force required to connect the filling means (or dispensing means) to the valve and the path length (degree of rotation) through which the filling means must be rotated to enable complete connection (and hence complete transfer of gas) with a single fluid movement (twist). This has the practical effect of significantly increasing usability of the product.

As will be understood by the skilled person, in practical use, it will be important that the filling means can be safely removed from the valve and, in embodiments when dispensing occurs though the same valve, that the dispensing means can be easily attached and later removed, if necessary for disposal etc. Consequently, the adaptor of the invention is conveniently provided with a release track, so that the pressurisable container and the filling or dispensing means may be separated again.

The release may be a snap release, achieved by further twisting the containers in the same direction as to connect them but applying pressure so as to move the cam beyond the end of the cam track, to release the cam from the track and hence separate the filling or dispensing means track. Alternatively the release track is defined by the cam track and release is effected by rotation in the opposite direction to that used to connect the valve to the filling or dispensing means.

In this embodiment, it will be understood that the "start" position of the cam track will mean the initial part of the track that is contacted by a cam through the process of connecting the filling or dispensing means to the pressurisable container and the "stop" position will be the lower terminal end but that these positions will be reversed when considering removal of the filling or dispensing means from the pressurisable container. It will also be understood that the cams and cam tracks referred to in each embodiment of the present invention are interchangeable in that they form a cooperating pair such that the cams may be provided on the adaptor if the tracks are provided on the component to be attached to the adaptor and vice versa.

The adaptor may be provided already attached to or formed as part of the pressurisable container or it may be made to be attached as a separate component. Conveniently the adaptor may simply be configured to snap fit over the valve of the pressurisable container. This is most convenient when the pressurisable container is in the form of an aerosol canister and enables simple manufacture such that the adaptor may be supplied separately, as part of a kit or fitted to the pressurisable container as part of the manufacturing process to provide a complete device.

In another aspect, the present invention provides a device for producing a sclerosing microfoam comprising:

- a pressurisable container containing a solution of sclerosing agent in a physiologically acceptable solvent, the pressurisable container being sealed by an aerosol valve through which contents may pass when the container is pressurised and the valve is actuated;
- a foaming element which is in fluid communication with the aerosol valve;
- an adaptor as described above, said adaptor connectable to the pressurisable container and which enables attachment of a source of physiologically-acceptable gas or of a foam dispensing means to the pressurisable container; and
- a source of physiologically-acceptable gas which is adapted to cooperate with the adaptor;

characterised in that, when the source of physiologically-acceptable gas is connected through the adaptor, the valve is opened upon rotation around the adaptor and physiologically-acceptable gas flows into the container until a predetermined pressure is reached.

To enable simple and smooth connection, the source of physiologically-acceptable gas comprises a gas outlet positioned within a generally hollow cylindrical element with an open end and comprising on its inner surface at least three protruding cams arranged to fit into the cam tracks of the adaptor.

Conveniently, the source of physiologically-acceptable gas is a pressurised aerosol canister adapted with a hollow cylindrical collar, which may be formed as an integral part of the canister or may be made separately and then fitted over the upper shoulder of the canister. The collar may conveniently be made from a thermoplastic material and further configured to snap fit over the shoulder of the canister.

The device may be supplied with the source of physiologically acceptable gas separated from the pressurisable container, in the form of a kit, for the user to connect together or it may be supplied as a complete device such that the user has only to rotate the source of gas and pressurusable container relative to each other to activate the device. In this embodiment, the device further comprises a removable spacer to prevent rotation of the pressurisable container and the source of physiologically acceptable gas around the adaptor until the spacer is removed. This prevents inadvertent activation during storage or transit and can also operate as a safety/security seal to ensure sterility, provide evidence of tampering and prevent inappropriate re-use of the device.

The removable spacer conveniently has the form of an annular collar at least partially positioned over the adaptor to prevent movement of the cams in the cam tracks. Preferably the spacer is of the same circumference and thickness as the collar through which the source of gas connects to the adaptor. Extra strength and security can be provided by configuring the spacer to have a locking means, such as a snap fit configuration, on the spacer to lock into adaptor or pressurisable container such that greater force to require to unclip the spacer before use.

In order to produce microfoam which the required bubble size distribution, the foaming element comprises one or more passages of cross sectional dimension 0.1 μm to 30 μm, through which physiologically-acceptable gas is passed when the source of physiologically-acceptable gas is connected to the pressurisable container and through which the solution of sclerosing agent and physiologically-acceptable gas is mixed when the container is pressurised and the valve is actuated, such that a microfoam is formed which has density in the range of from 0.07 to 0.19 g/ml density and has a half-life of at least 2 minutes.

In another aspect the present invention provides a device for producing a sclerosing microfoam comprising:

- a pressurised container containing a solution of sclerosing agent in a physiologically acceptable solvent and a physiologically acceptable gas mixture comprising nitrogen in the range of from 0.1-0.8% by volume, the remaining gas consisting essentially of at least 10% carbon dioxide with the remainder oxygen, the pressurised container being sealed by an aerosol valve through which the contents may pass when the container is pressurised and the valve is actuated;
- a foaming element which is in fluid communication with the aerosol valve;

an adaptor as described above which is connected to the pressurised container; and a foam dispensing means which comprises a cylindrical element, the internal surface of which comprises three cams to cooperate with the cam tracks on the adaptor to enable fluid connection with the valve characterised in that the foam dispensing means comprises a valve actuation means to open the valve and dispense foam.

The invention will now be described further by way of illustration only by reference to the following Figures and Examples.

FIGURES

Figure 1B:
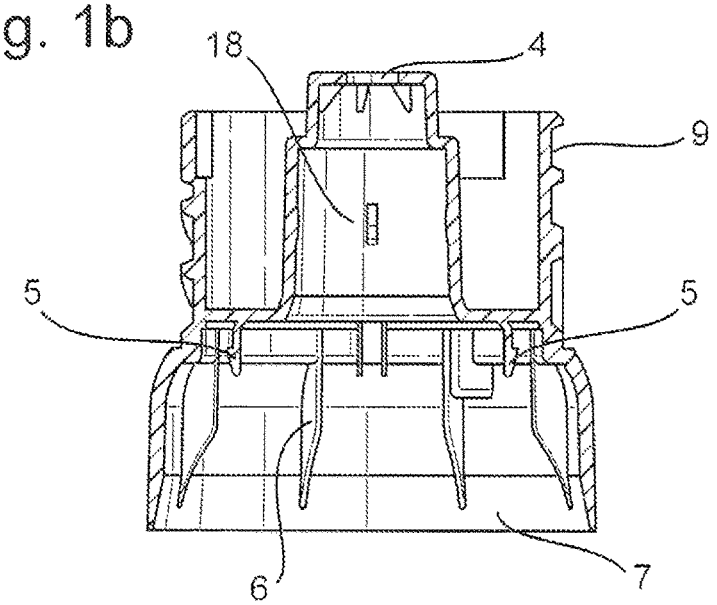
Figure 1C:
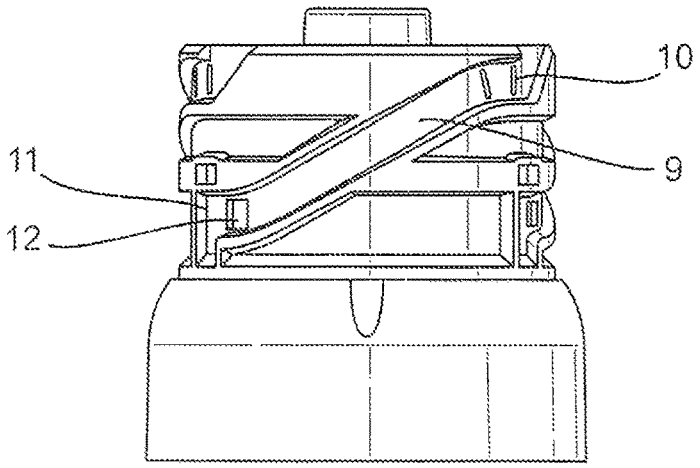

FIG. 1 shows a 3D representation of an adaptor according to the present invention (FIG. 1*a*). FIGS. 1*b* and 1*c* show side and cross-sectional views, respectively, of the adaptor of FIG. 1*a* and further described in Example 1 below.

Figure 2A:
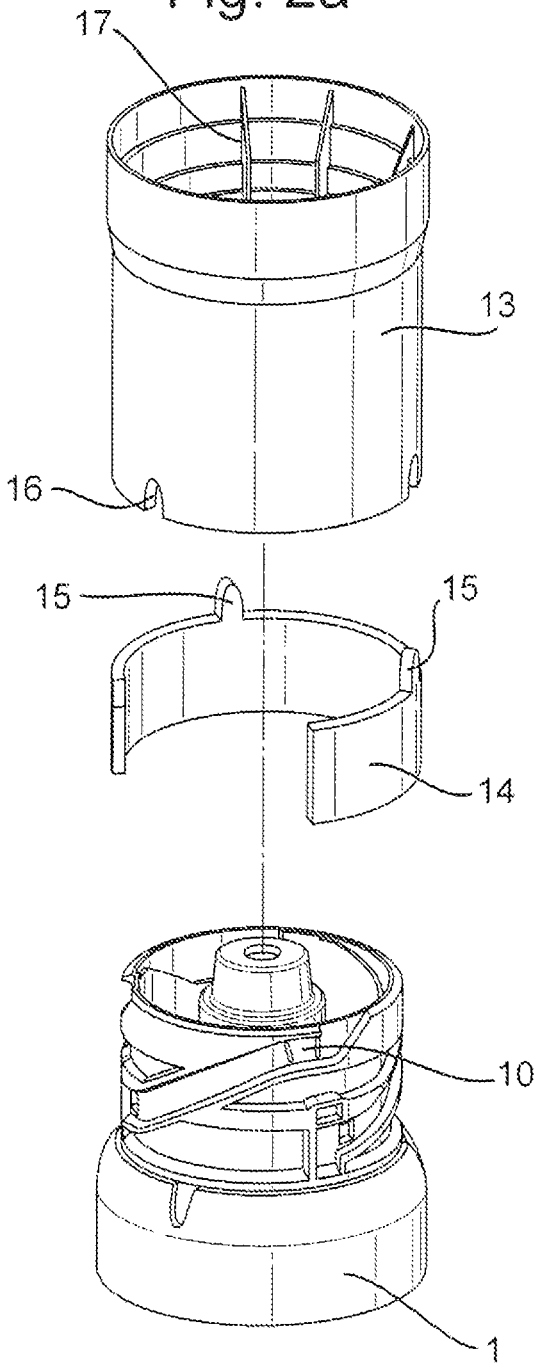
Figure 2B:
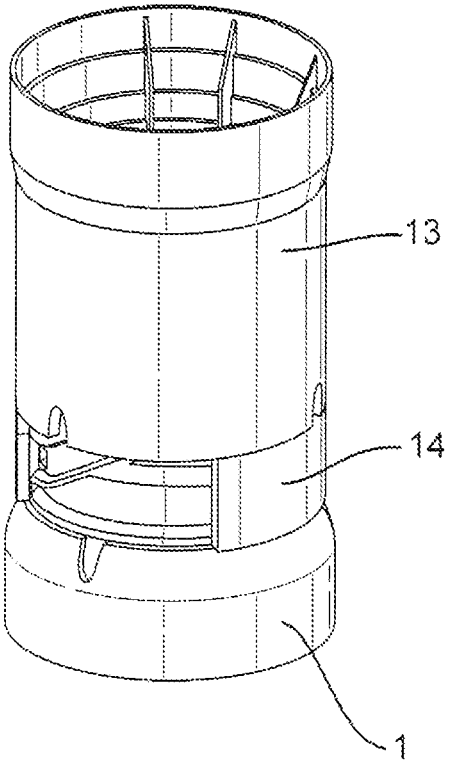

FIG. 2*a* shows an exploded view of the adaptor and collar for connecting the adaptor to the source of pressurised gas, FIG. 2*b* shoes the components connected, in cross-section.

Figure 3A:
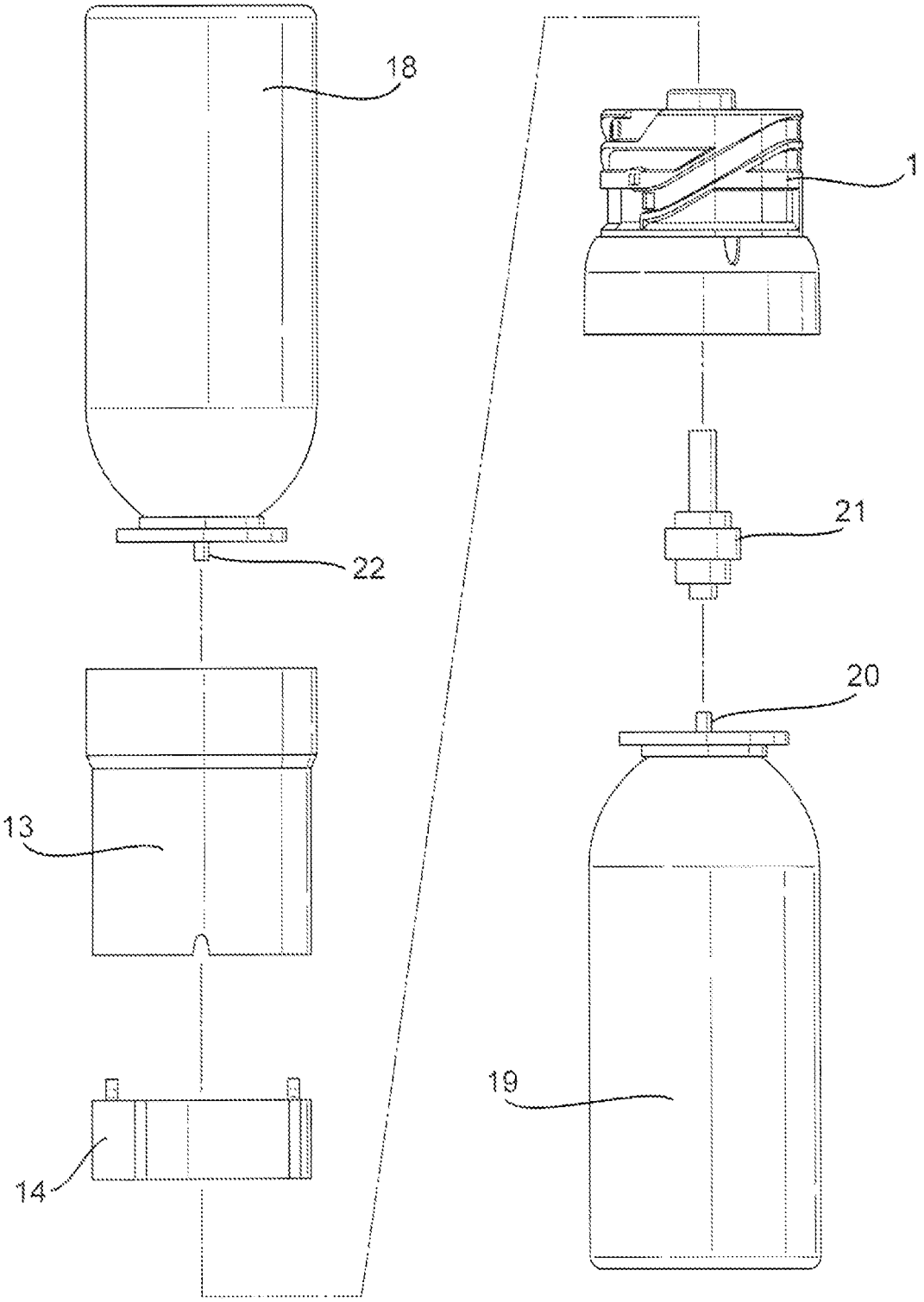

FIG. 3*a* shows an exploded view of a canister device of the second aspect of the invention with the source of pressurised gas connected to the pressurisable container.

Figure 3B:
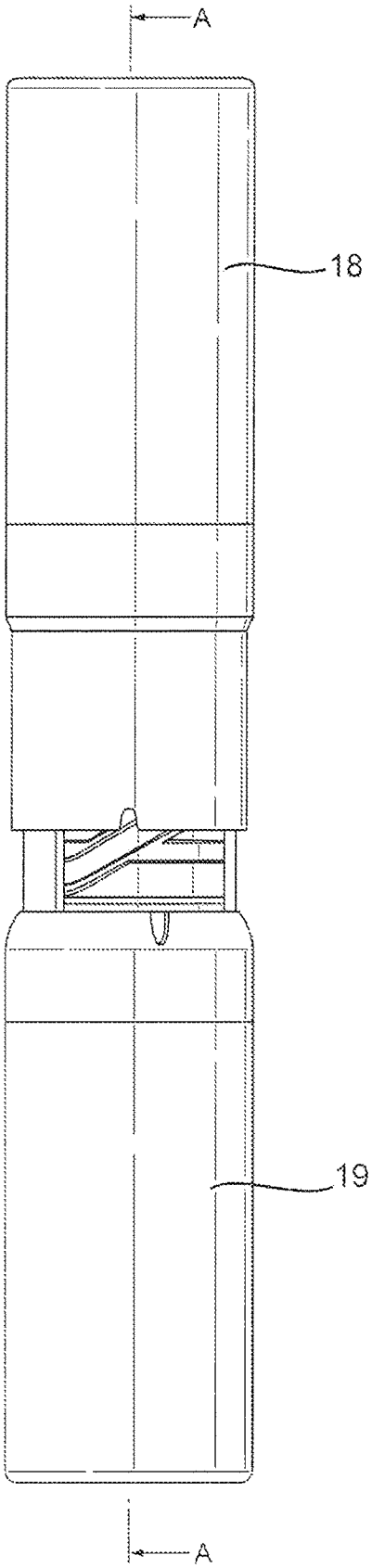

FIG. 3*b* is an assembled view of the components of FIG. 3*a*.

Figure 3C:
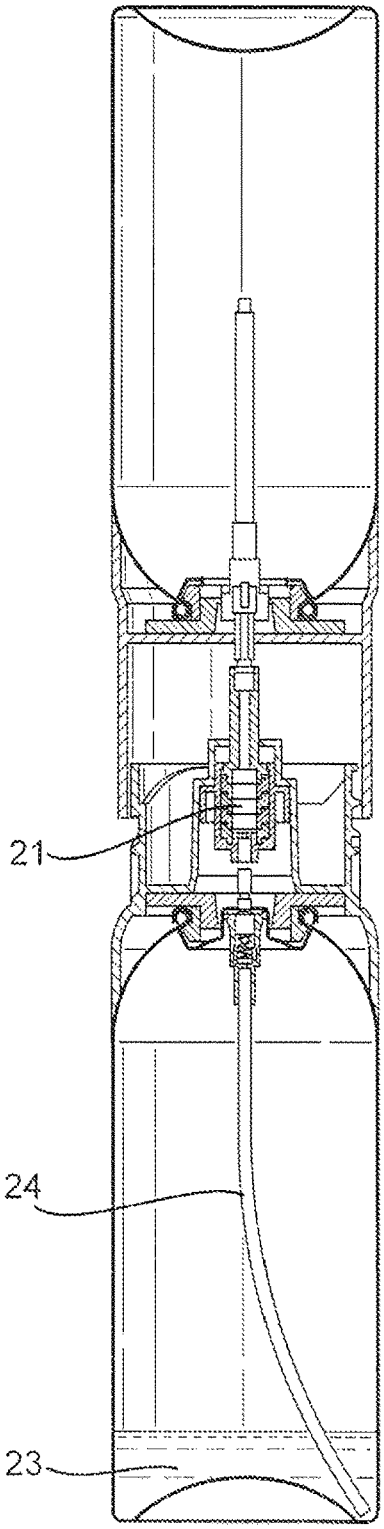

FIG. 3*c* is a cross-sectional view of the components of FIG. 3*a* connected.

Figure 4A:
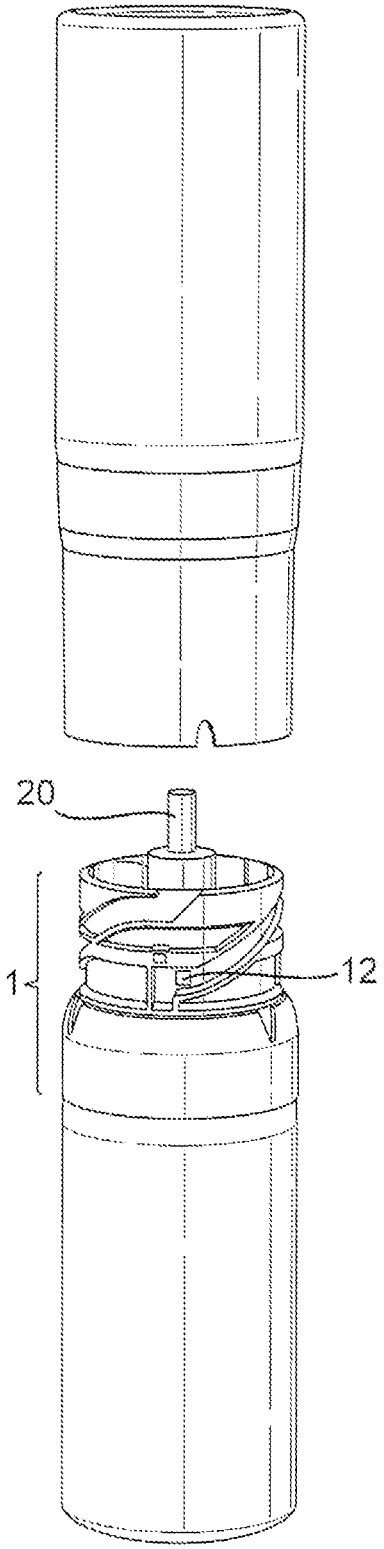
Figure 4B:
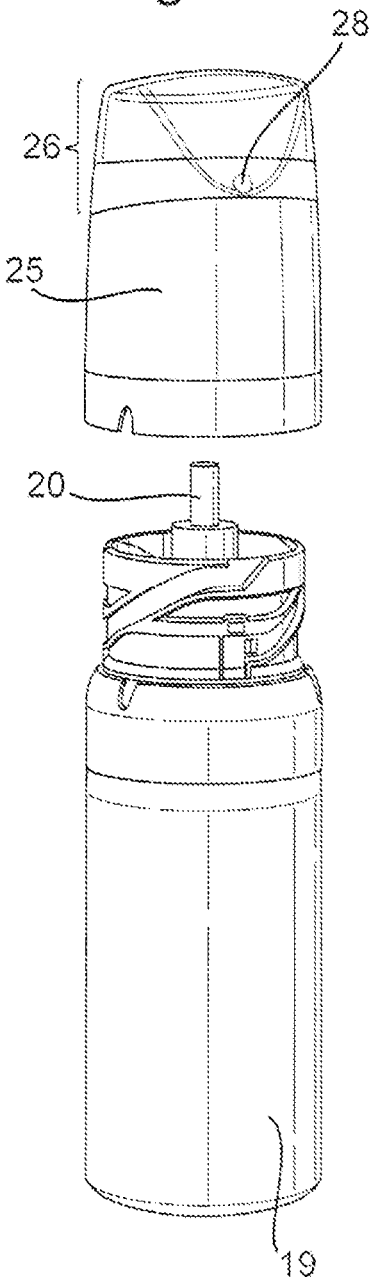
Figure 4C:
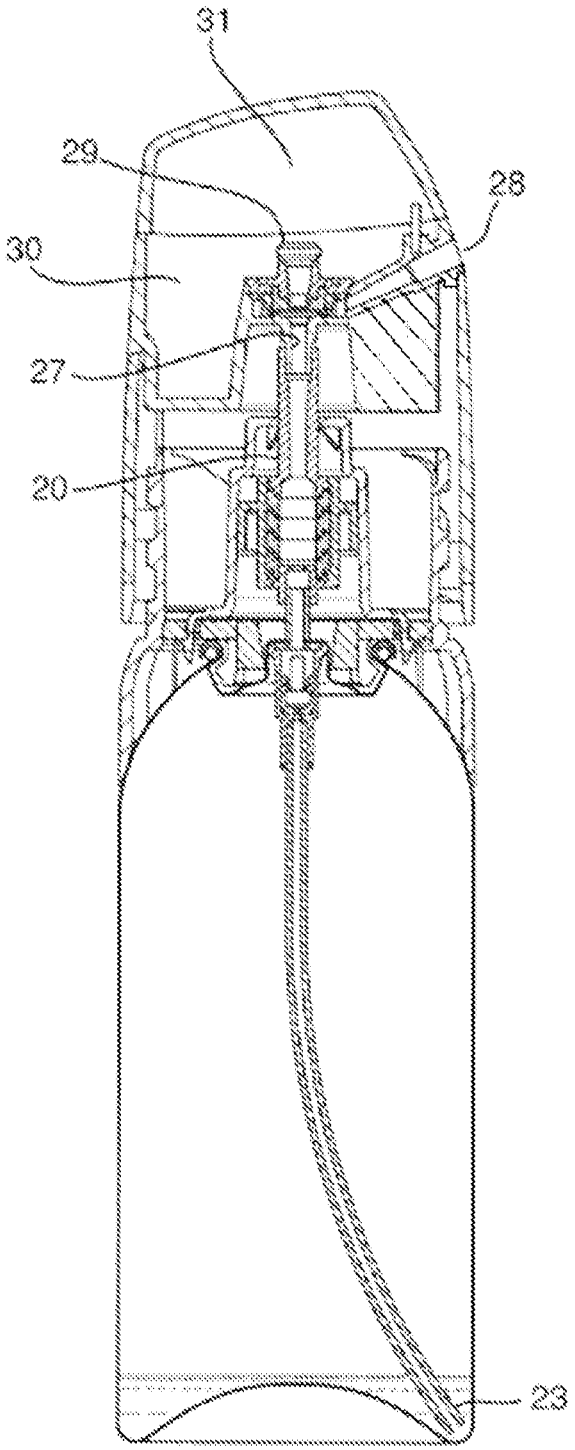

FIG. 4 shows an exploded view of a canister device of the second aspect incorporating the microfoam dispensing device.

EXAMPLES

FIG. 1 illustrates a typical adaptor of the first aspect of the invention. The adaptor [1] is generally cylindrical with an upper open end with a generally circular rim [2] and a lower open end with a generally circular lower rim [3]. The lower open end enables simple mechanical attachment of the adaptor to a pressurisable container, such as an aerosol canister, through snap-fit mountings [5] which are integrally formed inside a hollow portion [7] at the lower end of the adaptor (shown in FIG. 1*b*). The snap-fit mountings [5] are configured to engage a cup valve, such as the type which is typically crimped onto the mouth of a standard aerosol can (not shown in FIG. 1). The "teeth" of the snap fit mountings clip are pushed under the rim of the valve cup with high frictional force to hold the adaptor in place. Elongate ribs [6] are provided around the internal circumference of the hollow element which rest against the canister shoulder and support the adaptor such that movement of the adaptor relative to the canister is minimised. The upper portion of the adaptor comprises an inner bore [8] which extends through the inner section of the adaptor and is approximately at the centre of the adaptor to accommodate a valve and/or outlet stem of the pressurised canister. When connected to a canister, the valve stem (or container outlet) protrudes through the adaptor outlet [4].

The adaptor enables easy connection between a pressurised canister and a filling means for simple filling of the pressurised canister through the valve stem, easy removal thereafter and subsequent attachment of a dispensing means directly to the valve stem of the pressurisable canister through a male-female connection.

In this example the adaptor is provided in the male configuration and the filling means or dispensing means is adapted to provide a female counterpart, as described below.

The outer surface of the upper portion of the adaptor comprises three circumferentially and downward extending cam tracks [9] which are equally spaced around the circumference of the adaptor. The cam tracks are designed to cooperate with correspondingly spaced cams on the inner surface of the filling means or dispensing means. The cams will move along the cam tracks as the filling or dispensing means is rotated clockwise relative to the adaptor. The cam tracks are designed to ensure that as the cam travels to the end of the track, complete connection is achieved between the canister valve and the filling means.

The upper (i.e. initial portion of the cam track relative to the direction of travel) part of the cam track comprises two small rib-like protrusions [10] which act as a detent or catch ensuring that, after the cam of the filling means contacts the cam track, it can be held in position and rotation will only begin when additional force is required to force the cam over the protrusions. Two protrusions spaced apart by a distance that is just slightly larger than the diameter of the cams, enables the device to be provided with the filling means pre-attached to the adaptor but held securely between the two protrusions such that connection only occurs when the user applies sufficient force to move the cam over the second protrusion.

A wall is provided at the terminal end of the cam track to prevent over-rotation beyond the point of complete connection (approximately 120 degrees rotation). Towards the end of the cam track, and just before the end wall, a mechanical click-stop [12], in the form of a ramp-like protrusion, is provided such that the cam moves up and over the ramp easily and provides an audible "click" when the cam passes to provide feedback to the user that the connection is complete. The ramp shape of the click-stop also ensures that greater force is required to move the cam back along the cam track, such that the connection is maintained until the user is ready to disconnect. The dimensions of the ramp are selected such that a slightly increased force is required to disconnect the filling means from the canister by moving the cam backwards over the ramp as the filling means is rotated anticlockwise relative to the adaptor.

As indicated above, the cam track also acts as a release mechanism, for simple removal of the filling means, with additional force required to move the cams over the click-stop ramp and the detents to enable complete removal. Subsequent attachment and removal of a further filling means or a dispensing means operates in exactly the same way and attachment and detachment of the filling means.

FIG. 2 shows a configuration where the adaptor [1] is provided with a corresponding female adaptor [13] attached (but not fully connected). The corresponding female adaptor [13] which is snap-fitted to a canister comprising gas in a similar way as described above for the adaptor [1]. Ribs [17] are provided on the internal surface of the hollow female adaptor.

The adaptor is provided in the form shown is FIG. 2*b* in which the cams of the filling means are held in place between the detents [10] and further secured through the attachment of a removable spacer [14] which prevents rotation until it is removed. Additional security is provide by location lugs [15] which fit in corresponding arches in the filling means adaptor.

The same male-female connection is utilised for the attachment of a dispensing means, as discussed in more detail below.

FIG. 3 shows a device for producing a sclerosing microfoam. FIG. 3*b* shows a corresponding configuration to that shown in FIG. 2*b* but where a canister comprising physiologically acceptable blood-dispersible gas [18] is connected to a canister comprising an aqueous sclerosant liquid, [19] through the adaptor [1]. The device is provided in this form, with the removable spacer [14] holding the canister apart. The spacer is removed and the canister rotated, the same way as described above, to ensure complete connection of the two canisters through the adaptor. Once connected, the valve of the canister comprising physiologically acceptable blood-dispersible gas [18] is actuated and transfers its contents into canister comprising aqueous sclerosant liquid [19], through a mesh-stack shuttle component [21] which is connected to the valve [20] of the canister comprising aqueous sclerosant liquid [19].

The mesh-stack shuttle [21] is comprised of four injection moulded disk filters with mesh size of approximately 5 microns. These are pre-assembled within the casing. The mesh-stack shuttle is important for conditioning and controlling bubble size of microfoam later produced by the device but does not affect the transfer of gas from one canister to the other.

FIG. 3*c* shows a cross section of the device, when complete connection has been made and gas has transferred from the upper canister [18] into the lower canister [19] comprising sclerosant liquid [23]. This action produces a pressurised gas mix in the sclerosant liquid canister [19] at approximately 3.2 bar absolute pressure when the sterile gas transfer is completed. In this example, the canister [19] is prefilled with approximately 18 ml of polidocanol solution in buffer.

Each canister [18], [19] is a standard 200 to 350 ml design with an aluminium wall, the inside surface of which is coated with an epoxy resin resistant to action of polidocanol and oxygen (e.g. Hoba 7940, Holden UK). The bottom of the canister is domed inward. The dome provides a perimeter area around the bottom of the inner chamber in which a level of polidocanol solution is retained sufficient for the bottom open end of a dip tube [24] to be submerged therein when the top of the dome is no longer covered with the solution.

It takes about 30 seconds for the gas pressure to equilibrate between the two cans to a level of 3.15 bar±0.15 bar.

After transfer of the gas, the depleted canister may simply be removed by rotating it in the opposite direction until it becomes detached. The pressurised/filled canister is then ready for use directly or through attachment of a suitable dispensing device.

This is shown in FIG. 4: FIG. 4*a* shows detachment of the gas canister after transfer of the gas, by simply twisting the gas canister in the opposite (anticlockwise) direction. Increased force will be required by the user to force the cams over the "click-stop" ramp [12] and the detent protrusions in the reverse direction but is readily achievable within normal pressures ranges when applied by hand. FIG. 4*b* shows attachment of a microfoam dispensing device to the filled canister through the adaptor.

The dispensing device [25] is similar to that described in WO 2005/023678 (the contents of which are hereby incorporated by reference). The dispensing device comprises a lower skirt portion [25] and an upper dispensing and waste chamber portion [26]. The skirt portion [25] is generally hollow and adapted to comprise cams on its inner wall, to enable cooperation with the sunken cam tracks on the adaptor [1] and is attached to the pressurised canister [19] through the adaptor in the same way as described above. The upper portion [26] comprises an inlet [27] which is arranged generally in the centre of the device to enable direct communication and provide a gas-tight seal with the valve of the pressurised container when the dispensing device is attached. The inlet is connected to a usable foam outlet [28] in the form of an aperture sized so as to accommodate a syringe nozzle to enable direct transfer of microfoam from the dispensing device to a syringe and also to a valved waste outlet [29] which provides fluid communication with a waste chamber [30] which is enclosed within and forms an integral part of the upper portion of the device. Situated adjacent the usable foam outlet [28] and in communication with the inlet [27] is a waste bleed outlet [31] which has a higher resistance to flow of foam than that of the usable foam outlet and acts as an overflow valve into the waste chamber [30]. With the dispensing device is fitted to the pressurised canister, and a suitable syringe attached via its nozzle to the useable foam outlet [28], microfoam may be generated and dispensed as follows: With the syringe maintained in a fully depressed position, the entire dispensing device [25] is pressed down to depress the nozzle of the canister and thereby open the canister valve and start the flow of foam. This causes foam to flow from the canister valve [20], into the dispensing device via the canister valve [20] and the inlet [27] (which forms a gas-tight seal). Foam coming out of the canister is pressurised and the pressure of the foam forces closed the valved waste outlet [29] such that foam is directed towards the useable foam outlet [28]. However, foam cannot flow out of the usable foam outlet [28] because the syringe is blocking the outlet and so the foam flows out of the waste bleed outlet [31] and enters the waste container [30]. The quality of the initial foam will be of lower quality and will include air that is pushed out from dead space within the valve and dispensing device. Once a suitable quantity of foam has been directed to waste, the user can then simply release the syringe plunger, while continuing to depress the dispensing device. Foam may now flow through the usable foam outlet [28] into the syringe. A certain amount of resistance to flow of foam will be offered by the bore of the syringe nozzle (in this case a standard luer nozzle) and the passage usable foam outlet (that term being understood to include the passage leading from the valve chamber to the syringe nozzle). Further resistance will be offered by the syringe plunger as it is pushed back by foam entering the syringe. The dimensions of the waste bleed outlet [31] are designed with this in mind so that the resistance to flow offered by the bleed outlet is higher than the resistance encountered by the foam entering the syringe. Therefore, although foam will continue to flow into the waste chamber during this stage of the procedure, that flow will be considerably smaller than the flow into the syringe. It is of course desirable to minimise waste. In practice the dimensions of the waste bleed outlet [31] will be a compromise between minimising waste of foam, minimising the duration of the start up period before foam of acceptable quality is produced, and providing sufficient flow through the bleed port to prevent the device from "stuttering" and producing out of spec. foam after the initial purge to waste.

Once a quantity of good quality foam has been introduced into the syringe, the pressure on the dispensing device is released thereby shutting off flow from the canister. The syringe will then contain good quality foam, but also a bubble of air and/or poor foam caused by the dead air space in the usable foam outlet and syringe nozzle being pushed into the syringe by flow of foam. This air bubble or region of poor foam will normally be located adjacent the syringe plunger; therefore one option is for the user is to avoid fully emptying the syringe when using the foam, thus avoiding the injection of poor quality foam. The dead space can be minimised by using a design of syringe with virtually zero dead space, in which the plunger incorporates a projection which fills the nozzle. As an alternative, dead air space may be eliminated by flushing the dispensing device with good quality foam. This is achieved by simply depressing the syringe plunger to push foam back out of the syringe, through the usable foam outlet [28]. The pressure of the foam being pushed back into the dispensing device opens the valve on the valved waste outlet [29] and foam flows through it into the waste chamber. A small quantity of foam may also flow through the waste bleed outlet [31]. In this case, the initial quantity of foam allowed to enter the syringe can be minimised (to a few millilitres) as it will be used only to flush the system. After the initial purge and flush has taken place, the process is repeated without any flushing required and the syringe may be filled to the desired amount, the dispensing device released and the syringe containing the desired quantity of good quality foam is released and may be injected directly into the vein of a patient.

The invention claimed is:

1. An adaptor for connecting a filling or dispensing means to a valve of a pressurisable container, said adaptor comprising:

a cylindrical element with open ends and an inner wall and an outer wall therebetween, said open ends comprising a lower open end configured to enable attachment to the pressurisable container and an upper open end configured to enable attachment of a filling means or a dispensing means;

an inner bore to accommodate the valve of the pressurisable container and enable engagement of the valve with the filling means or dispensing means when attached through the upper open end of the device;

wherein the outer wall of the adaptor comprises three or more evenly spaced cam tracks which circumferentially and downwardly extend from a top initial portion to a bottom terminal end wall at a terminal end of each cam track, which cooperate with corresponding cams on the filling means or dispensing means, and which connect the valve of the pressurisable container to a fluid path of the filling or dispensing means when the pressurisable container and filling or dispensing means are rotated relative to each other.

2. An adaptor according to claim 1 wherein at least one cam track has one or more detents provided in the track to prevent automatic rotation of the containers and/or to enable the user to gauge the progress of the connection.

3. An adaptor according to claim 2 wherein two detents are provided in the top initial portion of the track and which, prior to rotation, are positioned either side of a cam on the filling means.

4. An adaptor according to claim 1 wherein the cam track has mechanical click-stop at the terminal end to prevent further rotation of the filling or dispensing means relative to the pressurisable container.

5. An adaptor according to claim 1 in which the angle of rotation required to connect the valve to the filling or dispensing means and provide a fluid path therebetween is approximately 120 degrees.

6. An adaptor according to claim 1 in which the cam track defines a pathway with gradient of approximately 35 degrees relative to the lower end of the adaptor.

7. An adaptor according to claim 1 wherein the cam track defines a pathway characterised by an initial and a final portion with gradient between 0 and 5 degrees, with a central higher gradient which is in the region of 35 degrees, relative to the lower end of the adaptor.

8. An adaptor according to claim 1 which is provided with a release track, so that the pressurisable container and the filling or dispensing means may be separated again.

9. An adaptor according to claim 8 wherein the release track is defined by the cam track and release is effected by rotation in the opposite direction to that used to connect the valve to the filling or dispensing means.

10. An adaptor according to claim 1 which is configured to snap fit on to the top of an aerosol canister.

11. A device for producing a sclerosing microfoam comprising:

a pressurisable container containing a solution of sclerosing agent in a physiologically-acceptable solvent, the pressurisable container being sealed by an aerosol valve through which contents may pass when the container is pressurised and the valve is actuated;

a foaming element which is in fluid communication with the aerosol valve;

an adaptor as described in claim 1 which is connected to the pressurisable container and which enables attachment of a source of physiologically-acceptable gas or of a foam dispensing means to the pressurisable container; and a source of physiologically-acceptable gas which is adapted to cooperate with the adaptor;

wherein, when the source of physiologically-acceptable gas is connected through the adaptor, the valve is opened upon rotation around the adaptor and physiologically-acceptable gas flows into the container until a predetermined pressure is reached.

12. A device according to claim 11 wherein the source of physiologically-acceptable gas comprises a gas outlet positioned within a generally hollow cylindrical element with an open end and comprising on its inner surface three protruding cams arranged to fit into the cam tracks of the adaptor.

13. A device according to claim 12 wherein the source of physiologically-acceptable gas is a pressurised aerosol canister adapted with a hollow cylindrical collar.

14. A device according to claim 11 which further comprises a removable spacer to prevent rotation of the pressurisable container and the source of physiologically-acceptable gas around the adaptor until the spacer is removed.

15. A device according to claim 14 wherein the removable spacer has the form of an annular collar at least partially positioned over the adaptor to prevent movement of the cams in the cam tracks.

16. A device according to claim 11 wherein the foaming element comprises one or more passages of cross sectional dimension 0.1 μm to 30 μm, through which physiologically-acceptable gas is passed when the source of physiologically-acceptable gas is connected to the pressurisable container and through which the solution of sclerosing agent and physiologically-acceptable gas is mixed when the container is pressurised and the valve is actuated, such that a microfoam is formed which has density in the range of from 0.07 to 0.19 g/ml density and has a half-life of at least 2 minutes.

17. A device for producing a sclerosing microfoam comprising:

a pressurised container containing a solution of sclerosing agent in a physiologically-acceptable solvent and a physiologically-acceptable gas mixture comprising nitrogen in the range of from 0.1-0.8% by volume, the remaining gas consisting essentially of at least 10% carbon dioxide with the remainder oxygen, the pressurised container being sealed by an aerosol valve through which the contents may pass when the container is pressurised and the valve is actuated;

a foaming element which is in fluid communication with the aerosol valve;

an adaptor as described in claim 1 which is connected to the pressurisable container; and a foam dispensing means which comprises a cylindrical element, the internal surface of which comprises three cams to cooperate with the cam tracks on the adaptor to enable fluid connection with the valve, wherein the foam dispensing means comprises a valve actuation means to open the valve and dispense foam.

* * * * *